US011807976B2

(12) United States Patent
Xu et al.

(10) Patent No.: US 11,807,976 B2
(45) Date of Patent: Nov. 7, 2023

(54) ATOMIZING GENERATOR AND CLOTHES TREATMENT APPARATUS COMPRISING THE ATOMIZING GENERATOR

(71) Applicants: QINGDAO HAIER WASHING MACHINE CO., LTD., Shandong (CN); Haier Smart Home Co., Ltd., Shandong (CN)

(72) Inventors: Sheng Xu, Qingdao (CN); Zhiqiang Zhao, Qingdao (CN); Dejun Wang, Qingdao (CN); Zhongkai Zhuang, Qingdao (CN); Guangbin Sun, Qingdao (CN)

(73) Assignees: QINGDAO HAIER WASHING MACHINE CO., LTD., Qingdao (CN); Haier Smart Home Co., Ltd., Qingdao (CN)

( * ) Notice: Subject to any disclaimer, the term of this patent is extended or adjusted under 35 U.S.C. 154(b) by 218 days.

(21) Appl. No.: 17/423,994

(22) PCT Filed: Jan. 6, 2020

(86) PCT No.: PCT/CN2020/070458

§ 371 (c)(1),
(2) Date: Jul. 19, 2021

(87) PCT Pub. No.: WO2020/151485

PCT Pub. Date: Jul. 30, 2020

(65) Prior Publication Data

US 2022/0081821 A1 Mar. 17, 2022

(30) Foreign Application Priority Data

Jan. 22, 2019 (CN) ..... 201910060553.9
Mar. 5, 2019 (CN) ..... 201910165012.2
Mar. 5, 2019 (CN) ..... 201910165475.9

(51) Int. Cl.
*D06F 39/00* (2020.01)
*D06F 39/08* (2006.01)
*D06F 39/02* (2006.01)

(52) U.S. Cl.
CPC ..... *D06F 39/008* (2013.01); *D06F 39/02* (2013.01); *D06F 39/088* (2013.01)

(58) Field of Classification Search
CPC ..... D06F 39/008; D06F 39/02; D06F 39/088
See application file for complete search history.

(56) References Cited

U.S. PATENT DOCUMENTS 5,865,171 A * 2/1999 Cinquin ..... A61M 16/08 128/200.14
9,487,902 B2 * 11/2016 Schulze ..... D06F 39/008
(Continued)

FOREIGN PATENT DOCUMENTS

CN 201033315 Y 3/2008
CN 201195794 Y 2/2009
(Continued)

OTHER PUBLICATIONS

Electronic translation of EP-2683658-B1. (Year: 2017).*
(Continued)

*Primary Examiner* — Joseph L. Perrin
(74) *Attorney, Agent, or Firm* — Maier & Maier, PLLC

(57) ABSTRACT

An atomizing generator and clothes treatment apparatus including the atomizing generator. The atomizing generator includes a housing, a partition plate being provided within the housing, the partition plate dividing the housing into an atomizing cavity and a mounting cavity which are in communication with each other; the atomizing cavity can accommodate liquid, an air inlet, a liquid inlet and a mist outlet which are in communication with the atomizing cavity are provided on the housing; and the atomizing generator further includes an atomizing element capable of atomizing the liquid within the atomizing cavity; a controller is provided in the mounting cavity, and the controller is connected to the atomizing element through a control wire to control the start/stop of the atomizing element. The embodiments
(Continued)

improve the integration level of the atomizing generator, facilitates the assembly and production of the clothes treatment apparatus, and improves the assembly efficiency and the yield.

8 Claims, 17 Drawing Sheets

(56) References Cited

U.S. PATENT DOCUMENTS

2006/0249144 A1* 11/2006 DeHaan ..... B05B 17/0615 128/200.14
2015/0225887 A1* 8/2015 Schulze ..... D06F 39/008 8/137
2015/0299926 A1* 10/2015 Kim ..... D06F 21/02 8/137
2019/0193529 A1* 6/2019 Lechat ..... B05B 17/0615

FOREIGN PATENT DOCUMENTS

CN 208032903 U 11/2018
CN 210177180 U 3/2020
EP 2683658 B1 * 11/2014 ..... B60H 3/022
JP 2009247770 A * 10/2009
WO 2018040841 A1 3/2018

OTHER PUBLICATIONS

Electronic translation of JP-2009247770-A. (Year: 2009).*
International Search Report dated Apr. 10, 2020 in corresponding International Application No. PCT/CN2020/070458; 5 pages.

* cited by examiner

ATOMIZING GENERATOR AND CLOTHES TREATMENT APPARATUS COMPRISING THE ATOMIZING GENERATOR

FIELD

The present invention relates to the technical field of clothes treatment, and more particularly, to an atomizing generator and a clothes treatment apparatus including the same.

BACKGROUND

As science and technology are developing and the living standard has improved, the household appliances have a trend of becoming multifunctional. Taking washing machines as an example, most of them have a steam washing function (or air washing) among others, the steam washing function is realized by an atomizing generator of which an atomizing element atomizes a liquid into steam and then sprays the steam into a washing drum through an atomizing pipe to treat clothes in the drum, so that clothes caring, such as wrinkle removal and peculiar smell dispelling, can be realized.

Typically, an atomizing generator includes a housing provided with an air inlet, a liquid inlet, and a mist outlet thereon, and only an atomizing element therein; whilst a circuit board for controlling the atomizing element is provided in the washing machine and is integrated with a control unit of the washing machine or shares one control box. This arrangement simplifies the structure of the atomizing generator but is disadvantageous for the assembling and production of the washing machine, as a result, the atomizing generator and the circuit board have to be mounted separately and then coupled through signal wires to assemble the washing machine, which greatly reduces the production efficiency and the yield.

Accordingly, there is a need in the art for a new atomizing generator that addresses the above problems.

SUMMARY

The present invention provides an atomizing generator to solve the above-mentioned problem in the prior art of low production efficiency of a clothes treating apparatus caused by low integration of a conventional atomizing generator. The atomizing generator includes a housing provided with a partition plate therein, the partition plate dividing the housing into an atomizing cavity and a mounting cavity which are communicated with each other, and the atomizing cavity being capable of containing a liquid. The housing is provided with an air inlet, a liquid inlet and a mist outlet which are communicated with the atomizing cavity, the atomizing generator further includes an atomizing element capable of atomizing the liquid in the atomizing cavity, a controller is provided in the mounting cavity, and the controller is connected to the atomizing element through a control wire to control the start/stop of the atomizing element.

In a preferred technical solution of the atomizing generator, a bottom of the housing is provided with a water-permeable hole, and an atomizing film is fixed by an atomizing film holder outside the housing corresponding to the water-permeable hole.

In a preferred technical solution of the atomizing generator, the atomizing element is an ultrasonic atomizing film, a driving circuit board used for driving the ultrasonic atomizing film is further mounted in the atomizing film holder, a threading hole is formed in a bottom surface of the mounting cavity, and the control wire has one end connected to the driving circuit board and the other end connected to the controller through the threading hole.

In a preferred technical solution of the atomizing generator, the air inlet is disposed at a position on the housing corresponding to the mounting cavity, an air flow passage is formed between the air inlet and the mist outlet, and the air flow passage goes through part of the controller.

In a preferred technical solution of the atomizing generator, the housing includes a housing body and a housing cover, the partition plate is disposed in the housing body and is provided with a notch, and the notch is arranged corresponding to the controller.

In a preferred technical solution of the atomizing generator, a wind shield extends downwards from the housing cover, and the wind shield extends into the atomizing cavity and is arranged corresponding to the notch.

In a preferred technical solution of the atomizing generator, a fan is provided between the air inlet and the controller, an air indrawing opening of the fan is arranged corresponding to the air inlet, an air exhaust opening of the fan is arranged to face the partition plate, and the controller is connected to the fan to control the start/stop of the fan.

In a preferred technical solution of the atomizing generator, a communicating cavity is further provided in the housing, the atomizing cavity is communicated with the communicating cavity through a first communication hole, and the mist outlet is communicated with the communicating cavity through a second communication hole.

In a preferred technical solution of the atomizing generator, the mist outlet is disposed on a bottom surface of the housing, the atomizing generator further includes a connecting pipe, and the mist outlet is communicated with the second communication hole through the connecting pipe; additionally/alternatively, a valve mechanism is further provided in the communicating cavity, the valve mechanism is configured to be capable of sealing the first communication hole and/or the second communication hole, and the controller is connected to the valve mechanism to control the opening/closing of the valve mechanism.

The present invention further provides a clothes treatment apparatus which includes a tank, a washing drum and a control unit, the washing drum and the control unit are arranged in the tank. The clothes treatment apparatus further includes the atomizing generator according to any of the above preferred technical solutions, the liquid inlet is communicated with a water source through a liquid inlet pipe, the mist outlet is communicated with the washing drum through a mist outlet pipe, and the controller is connected to the control unit through a cable.

As appreciated by those skilled in the art, in the preferred technical solutions of the present invention, the atomizing generator includes a housing, a partition plate being provided within the housing, the partition plate dividing the housing into an atomizing cavity and a mounting cavity which are in communication with each other; the atomizing cavity can accommodate liquid, an air inlet, a liquid inlet and a mist outlet which are in communication with the atomizing cavity are provided on the housing; the atomizing generator further includes an atomizing element capable of atomizing the liquid within the atomizing cavity; a controller is provided in the mounting cavity, and the controller is connected to the atomizing element by means of a control wire to control the start/stop of the atomizing element.

The arrangement described above greatly improves the integration level of the atomizing generator, and thus it is much easier to assemble the clothes treatment apparatus, which facilitates assembling and production, and in turn, increases the assembling efficiency and the yield. Specifically, the partition plate is provided in the housing to divide the housing into the atomizing cavity and the mounting cavity, and the controller connected to the atomizing element is provided in the mounting cavity, so that the controller and the atomizing element are assembled well before delivery, which simplified the subsequent assembling process because it would be enough to connect the controller with the control unit of the clothes treatment apparatus when mounting the atomizing generator.

Furthermore, the arrangement where the air inlet is arranged at the position of the housing corresponding to the mounting cavity, the air flow passage is formed between the air inlet and the mist outlet, and the air flow passage flows part of the controller enables that part of heat of the controller can be dissipated by ambient air entering the housing from the air inlet, the controller is thus effectively cooled, and the reliability and the service life of the controller are greatly improved.

The present invention also provides an atomizing generator which includes a housing provided with an atomizing cavity therein, an atomizing element capable of atomizing a liquid is provided in the atomizing cavity, an air inlet, a liquid inlet, and a mist outlet which are communicated with the atomizing cavity are provided on the housing, and a communicating cavity which is independent of the atomizing cavity is formed in the housing. The atomizing cavity is communicated with the communicating cavity through a first communication hole, the mist outlet is communicated with the communicating cavity through a second communication hole, a valve mechanism is further provided in the communicating cavity, and the valve mechanism is configured to be capable of sealing the first communication hole and/or the second communication hole.

In a preferred embodiment of the atomizing generator, the valve mechanism includes a drive portion and a sealing block, the drive portion being capable of driving the sealing block to slide reciprocally within the communicating cavity.

In a preferred technical solution of the atomizing generator, the housing includes a housing body and a first housing cover, wherein a transverse rib and a vertical rib are provided on the first housing cover, the transverse rib is fixedly connected to three sequentially adjacent inner side surfaces of the first housing cover, and the vertical rib is fixedly connected to two opposite ones of the three sequentially adjacent inner side surfaces, so that the transverse rib, the vertical rib and the three inner side surfaces jointly enclose the communicating cavity.

In a preferred embodiment of the atomizing generator, the housing further includes a second housing cover capable of covering the communicating cavity.

In a preferred technical solution of the atomizing generator, the first communication hole and the second communication hole are arranged on the transverse rib, the mist outlet is disposed at a bottom of the housing, the atomizing generator further includes a connecting pipe, and the mist outlet is connected to the second communication hole through the connecting pipe.

In a preferred technical solution of the atomizing generator, a partition plate is provided in the housing and divides the housing into a mounting cavity and the atomizing cavity, a controller is provided in the mounting cavity and is connected to the atomizing element and the valve mechanism, respectively, to control the start/stop of the atomizing element and the opening/closing of the valve mechanism.

In a preferred technical solution of the atomizing generator, the partition plate is provided with a notch, a wind shield extends downwards from a bottom surface of the transverse rib, and the wind shield extends into the atomizing cavity and is arranged corresponding to the notch.

In a preferred technical solution of the atomizing generator, the air inlet is provided with a fan, and the controller is further connected to the fan to control the start/stop of the fan.

In a preferred technical solution of the atomizing generator, the atomizing element is an ultrasonic atomizing film, a bottom of the housing is provided with a water-permeable hole, and the ultrasonic atomizing film is placed outside the housing corresponding to the water-permeable hole.

The present invention also provides a clothes treatment apparatus which includes a tank and a washing drum in the tank, wherein the clothes treatment apparatus further includes a drying module and the atomizing generator according to any of the preferred technical solutions, the liquid inlet of the atomizing generator is communicated with a water source through a liquid inlet pipe, and the mist outlet is communicated with the washing drum through a mist outlet pipe.

As appreciated by those skilled in the art, in the preferred technical solutions of the present invention, the atomizing generator includes the housing provided with the atomizing cavity therein, the atomizing element capable of atomizing a liquid is provided in the atomizing cavity, the air inlet, the liquid inlet and the mist outlet which are communicated with the atomizing cavity are provided on the housing, and the communicating cavity which is independent of the atomizing cavity is also formed in the housing; the atomizing cavity is communicated with the communicating cavity through the first communication hole, the mist outlet is communicated with the communicating cavity through the second communication hole, the valve mechanism is further provided in the communicating cavity, and the valve mechanism is configured to be capable of sealing the first communication hole and/or the second communication hole.

The arrangement of the communicating cavity in the atomizing generator and of the valve mechanism in the communicating cavity enables greatly improved safety of operating the washing machine when the atomizing generator is implemented in a washing machine having a drying module because a situation where electrical elements are affected with dampness and short-circuited due to damp-heat air flows back to the atomizing generator and an interior of the washing machine when the drying module is started is effectively avoided. Specifically, the communicating cavity which is independent of the atomizing cavity is provided in the housing, and the atomizing cavity is communicated with the mist outlet through the communicating cavity, hence the communicating cavity becomes a passage necessary for the mist to reach the mist outlet from the atomizing cavity. The arrangement where the valve mechanism is provided in the communicating cavity and can seal the first communication hole and/or the second communication hole enables that the passage can be completely cut off by the valve mechanism, and thus an air flow from the exterior is prevented from flowing back to the atomizing generator through the mist outlet, in particular, failures such as short-circuited electrical elements, affected with damp, in the atomizing generator and the washing machine are avoided because the humid air in the washing drum can be prevented from flowing back to the atomizing generator and then is discharged into the washing machine from the air inlet when the drying module of the washing machine is started, as a result, the safety of operating the washing machine is greatly improved. Moreover, such an arrangement has high feasibility and excellent effects, advantageous for mass promotion and application.

BRIEF DESCRIPTION OF DRAWINGS

Hereinafter, an atomizing generator of the present invention and a clothes treating apparatus including the same will be described with reference to the accompanying drawings in conjunction with a drum washing machine. In the drawings.

DETAILED DESCRIPTION

Figure 1:
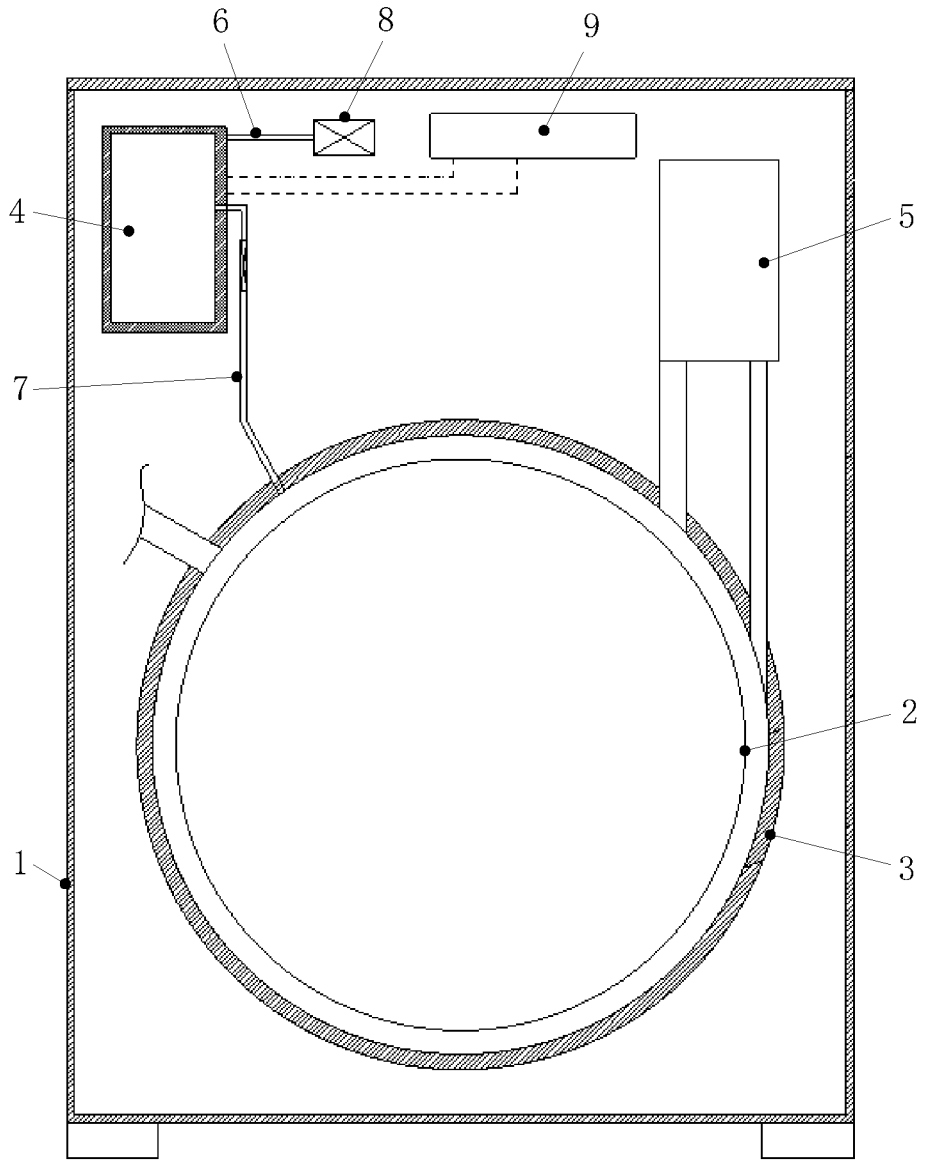
FIG. 1 is a schematic view showing a structure of a drum washing machine according to Embodiment 1 of the present invention.

Preferred embodiments of the present invention will now be described with reference to the accompanying drawings. As appreciated by those skilled in the art, these embodiments are merely illustrative of the technical principles of the present invention and are not intended to limit the scope of the present invention. For example, although the embodiments are described in connection with a drum washing machine, it is not intended to limit the scope of the present invention, and the present invention may be applied to other clothes treating apparatuses such as a pulsator washing machine or a washing and drying machine.

It is to be understood that in the description of the present invention, terms such as "center", "upper", "lower", "left", "right", "vertical", "horizontal", "inner" and "outer" refer to directions or positional relationships based on those shown in the drawings for ease of description only, rather than indicate or imply that the device or element must have a particular orientation or be constructed and operated in a particular orientation, and thus should not be construed as limiting the present invention. Furthermore, terms such as "first", "second" and "third" are used for descriptive purposes only and are not to be construed as indicating or implying any relative importance.

Furthermore, it is to be understood that in the description of the present invention, terms such as "mounted", "connected" and "coupled" are to be interpreted broadly, for example, fixedly, removably, or integrally; either mechanically or electrically; either directly or indirectly through an intermediary; or internally between two elements. The specific meaning of the above terms in the present invention will be understood by those skilled in the art as appropriate.

Embodiment 1

Figure 2:
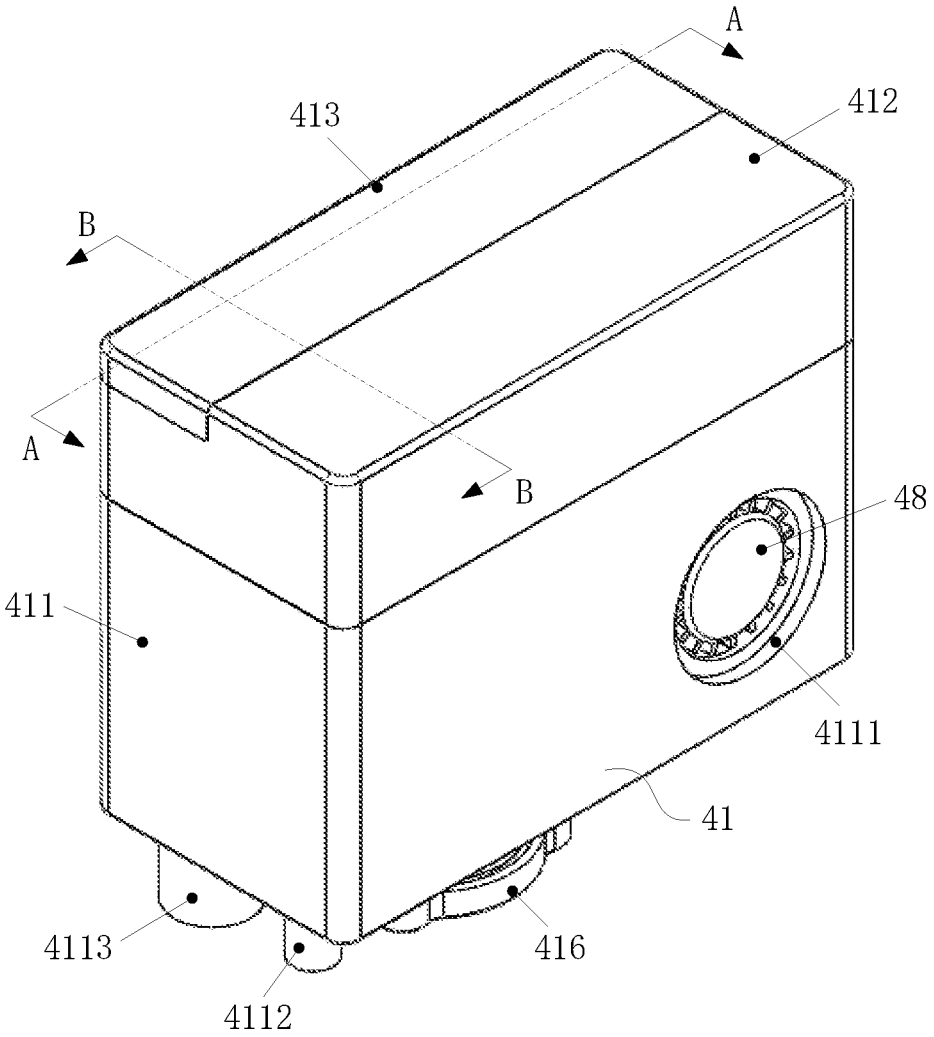
FIG. 2 is an external view (I) of an atomizing generator according to Embodiment 1 of the present invention.
Figure 3:
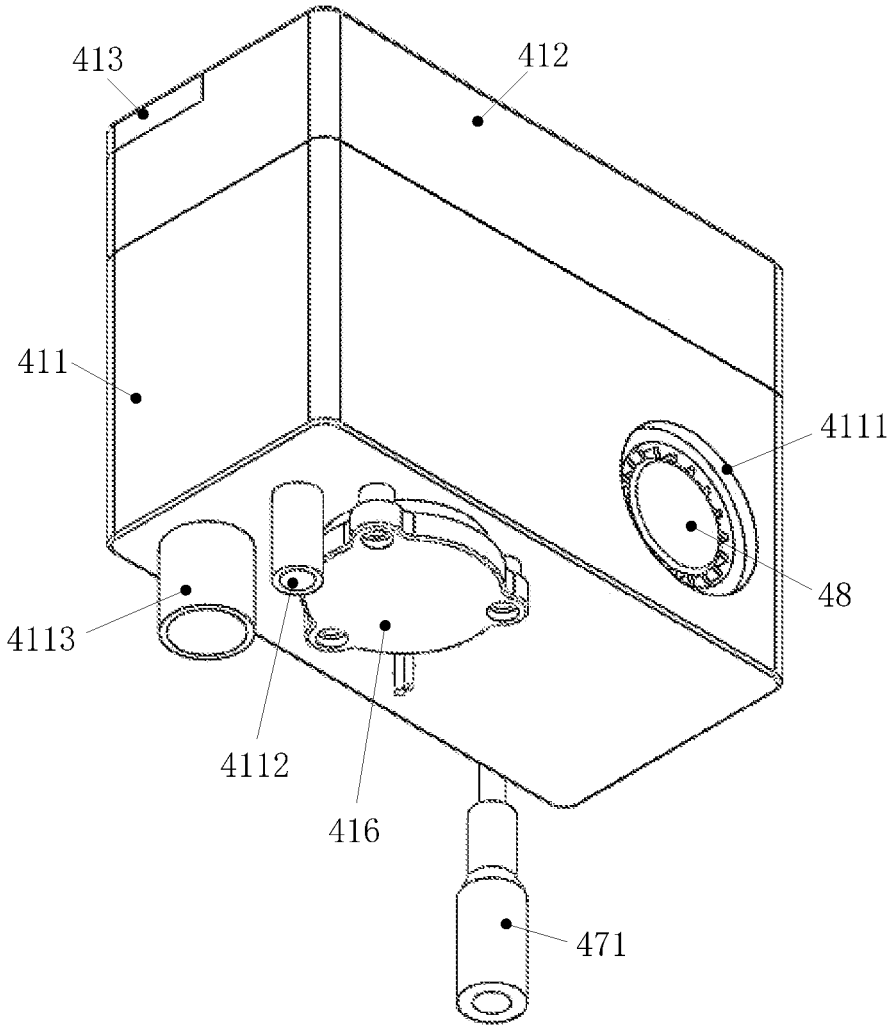
FIG. 3 is an external view (II) of the atomizing generator according to Embodiment 1 of the present invention.
Figure 4:
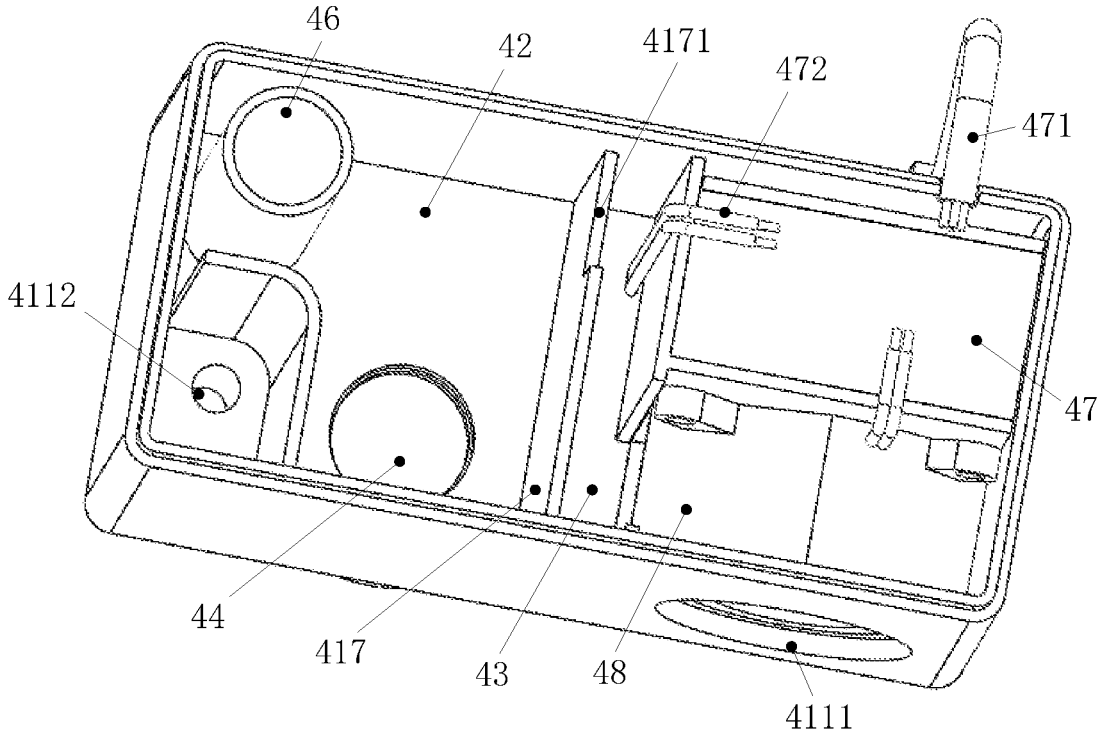
FIG. 4 is a structural view showing an interior of a housing body of the atomizing generator according to Embodiment 1 of the present invention.

Referring first to FIGS. 1 to 4, a drum washing machine of the present invention will be described. In the drawings, FIG. 1 is a schematic view showing a structure of a drum washing machine according to Embodiment 1 of the present invention; FIG. 2 is an external view (I) of an atomizing generator according to Embodiment 1 of the present invention; FIG. 3 is an external view (II) of the atomizing generator according to Embodiment 1 of the present invention; FIG. 4 is a structural view showing an interior of a housing body of the atomizing generator according to Embodiment 1 of the present invention.

As shown in FIG. 1, to solve the problem of low production efficiency of clothes treating apparatus caused by low integration of the conventional atomizing generator 4, the drum washing machine of the present invention mainly includes a tank 1, and an inner drum 2, an outer drum 3, an atomizing generator 4, a drying module 5 and a control unit 9 provided in the tank 1. The inner drum 2 is used for containing clothes, and the drying module 5 is circularly communicated with the outer drum 3 to dry clothes in the inner drum 2 by providing hot air flow to the outer drum 3 and the inner drum 2. The atomizing generator 4 is communicated with a water source through a liquid inlet pipe 6 and an electromagnetic valve 8 and is communicated with the outer drum 3 through a mist outlet pipe 7; when the atomizing generator 4 is working, the water enters the atomizing generator 4 through the electromagnetic valve 8 and the liquid inlet pipe 6 from the water source, the atomizing generator 4 atomizes the water into mist, and the mist is sprayed to the inner drum 2 through the mist outlet pipe 7 to treat clothes in the inner drum 2.

Referring to FIGS. 2 to 4, the atomizing generator 4 includes a housing 41 and an atomizing element 44 capable of atomizing a liquid into steam. A partition plate 417 is provided in the housing 41 and divides the housing 41 into an atomizing cavity 42 and a mounting cavity 43 which are communicated with each other, the atomizing cavity 42 being capable of containing a liquid; an air inlet 4111, a liquid inlet 4112 and a mist outlet 4113 which are communicated with the atomizing cavity 42 are provided on the housing 41, wherein the liquid inlet 4112 is connected to the liquid inlet pipe 6, and the mist outlet 4113 is connected to the mist outlet pipe 7. A controller 47 is provided in the mounting cavity 43 and is connected to the control unit 9 through a cable 471 and to the atomizing element 44 through a control wire 472 to control the start/stop of the atomizing element 44.

By advantage of the above arrangement, the integration level of the atomizing generator 4 is greatly improved, so that the difficulty in assembling the clothes treatment apparatus is reduced, which facilitates the production and improves the assembling efficiency and the yield. Specifically, in the atomizing generator 4 of the present invention, the controller 47 is assembled with the atomizing element 44 well before the time of delivery, which is realized by providing the partition plate 417 in the housing 41 to divide the housing 41 into the atomizing cavity 42 and the mounting cavity 43, and providing the controller 47 connected to the atomizing element 44 in the mounting cavity 43, as a result, when assembling the drum washing machine, it would be enough to mount the atomizing generator 4 at a set position inside the drum washing machine and plug the controller 47 with the control unit 9 through the cable 471, so that the assembling process is greatly simplified with an improved assembling efficiency.

Figure 5:
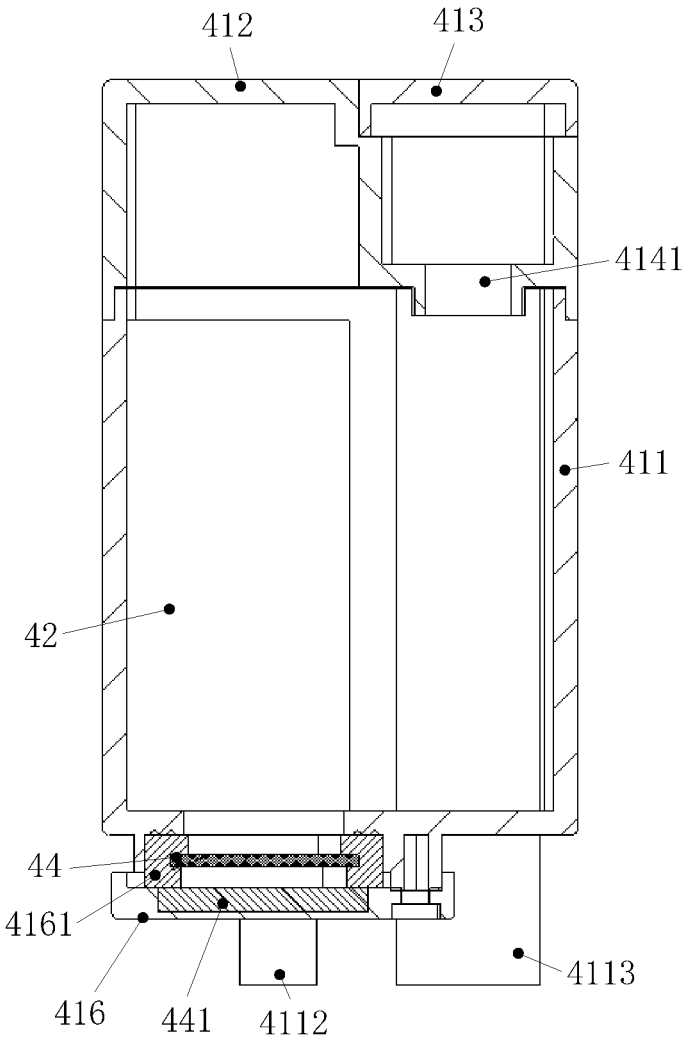
FIG. 5 is a cross-sectional view of FIG. 2 at B-B.
Figure 6:
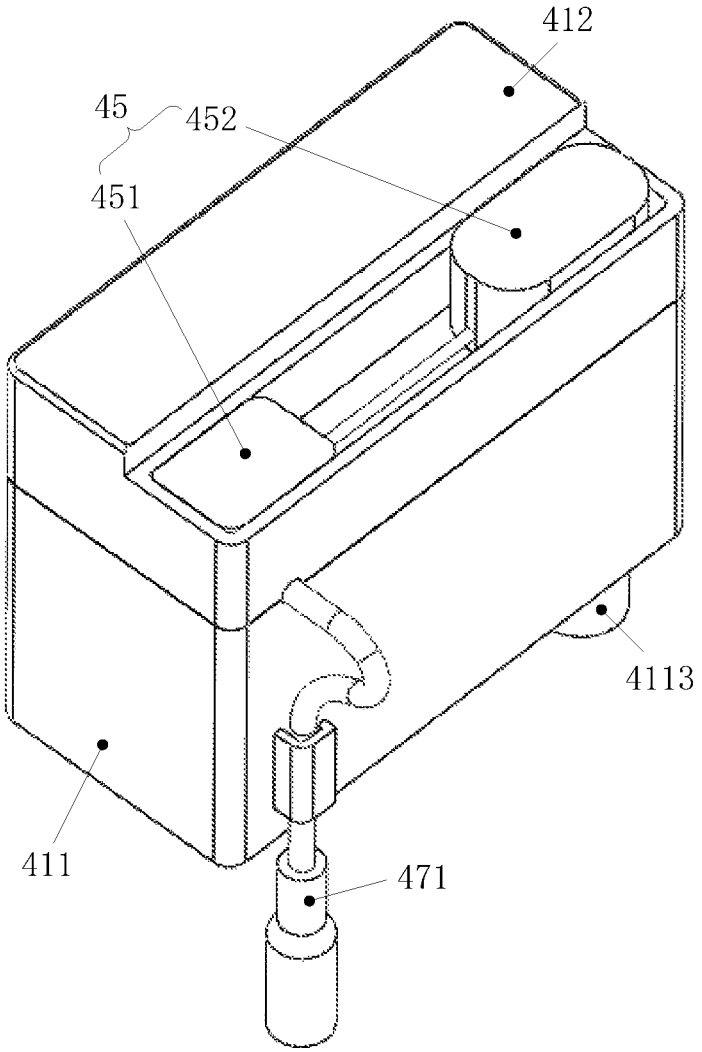
FIG. 6 is a structural view of the atomizing generator according to Embodiment 1 of the present invention with the second housing cover removed.
Figure 7:
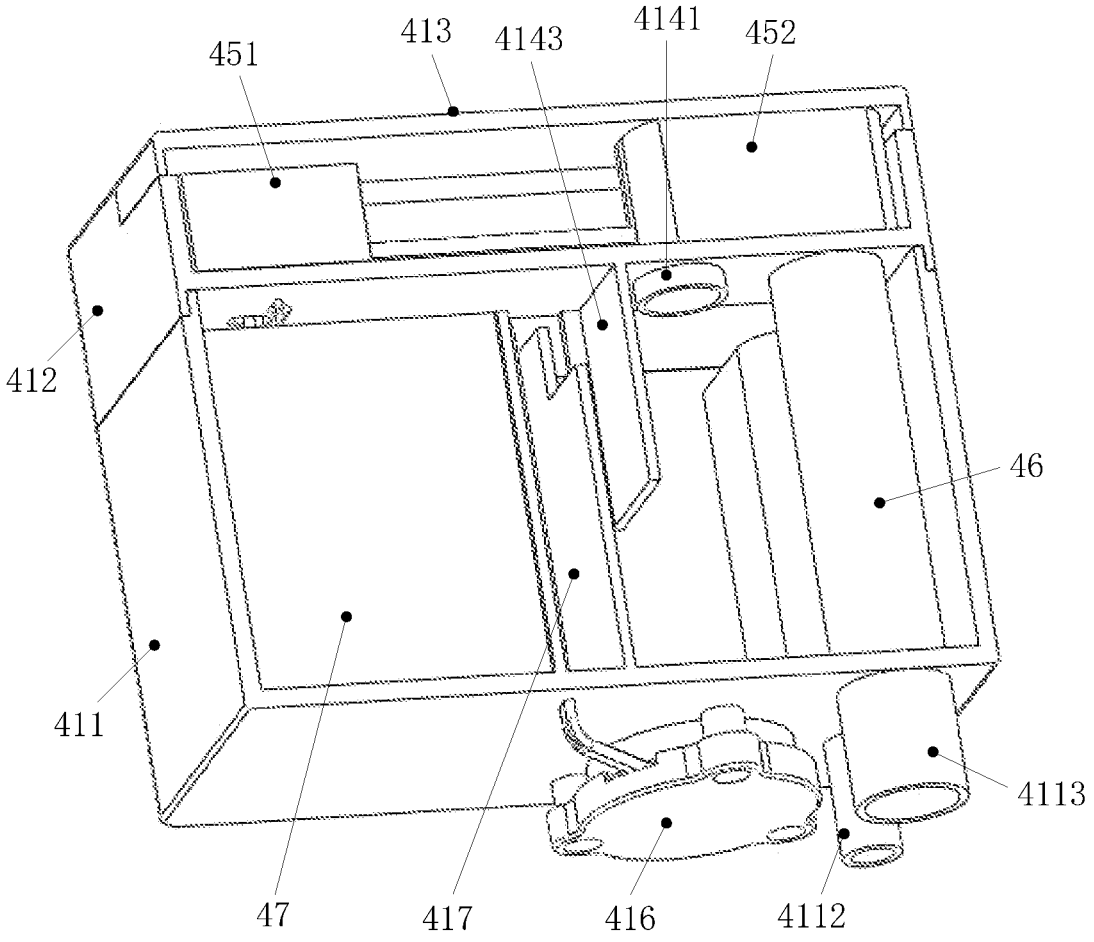
FIG. 7 is a cross-sectional view of FIG. 2 at A-A.
Figure 8:
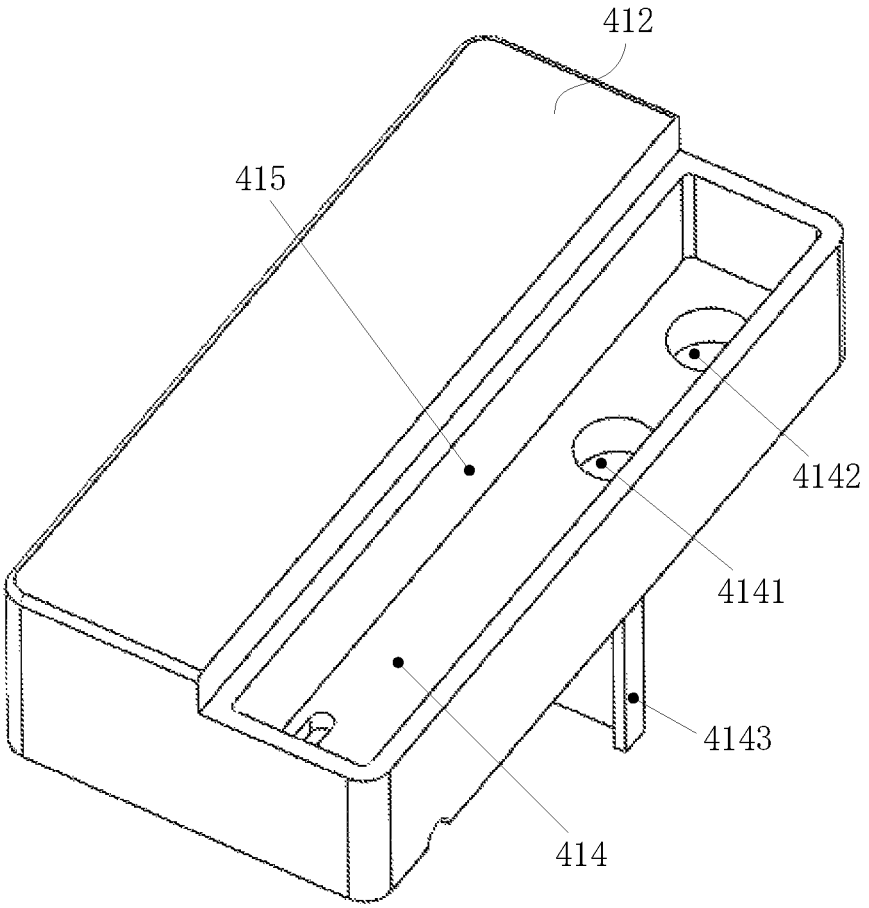
FIG. 8 is a structural view (I) of a first housing cover of the atomizing generator according to Embodiment 1 of the present invention.
Figure 9:
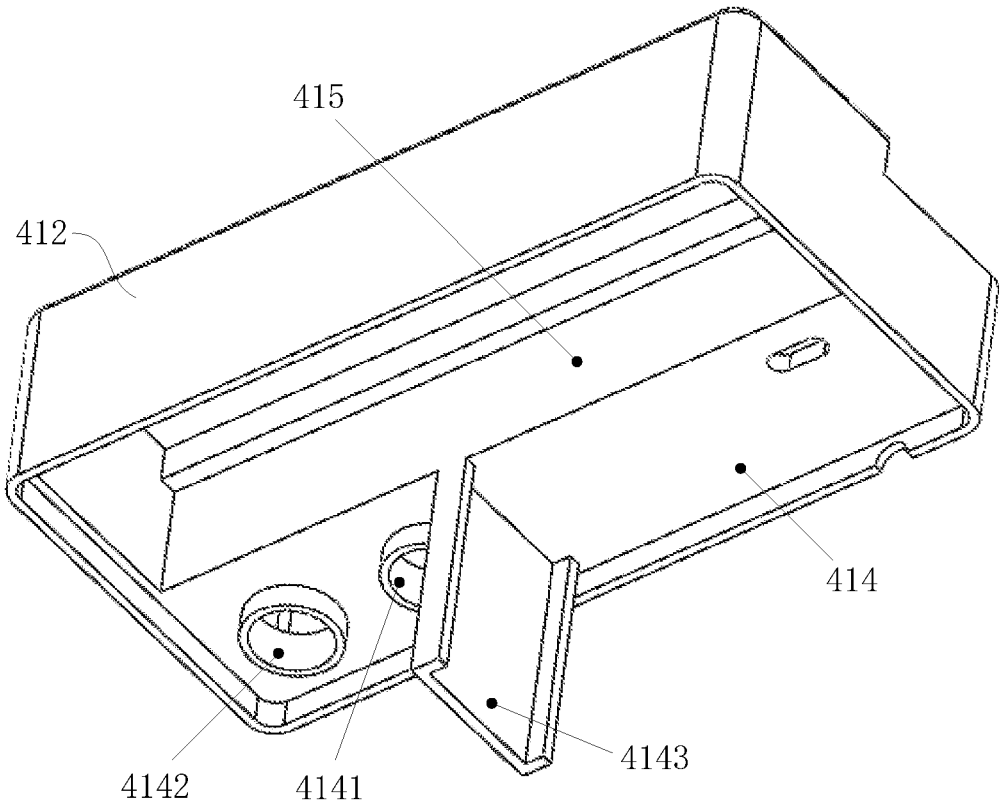
FIG. 9 is a structural view (II) of the first housing cover of the atomizing generator according to Embodiment 1 of the present invention.

The atomizing generator will be described in detail with reference to FIGS. 2 to 9, wherein FIG. 5 is a cross-sectional view of FIG. 2 at B-B; FIG. 6 is a structural view of the atomizing generator according to Embodiment 1 of the present invention with the second housing cover removed; FIG. 7 is a cross-sectional view of FIG. 2 at A-A; FIG. 8 is a structural view (I) of a first housing cover of the atomizing generator according to Embodiment 1 of the present invention; FIG. 9 is a structural view (II) of the first housing cover of the atomizing generator according to Embodiment 1 of the present invention.

As shown in FIGS. 2 to 4, in one possible embodiment, the housing 41 includes a housing body 411, a first housing cover 412, and a second housing cover 413, wherein a partition plate 417 is provided in the housing 41 to divide the housing body 411 into an atomizing cavity 42 and a mounting cavity 43 which are communicated with each other, a bottom surface of the housing body 411 is provided with the liquid inlet 4112 and the mist outlet 4113 at a side corresponding the atomizing cavity 42 and a side surface of the housing body 411 is provided with the air inlet 4111 at a position corresponding to the mounting cavity 43. Referring to FIG. 5, a water-permeable hole (not shown) is provided at a bottom of the atomizing cavity 42, and the atomizing element 44 is preferably an ultrasonic atomizing film provided outside the housing body 411 and hermetically connected at the water-permeable hole with a seal 4161 in an atomizing film holder 416 for atomizing the liquid in the atomizing cavity 42 into mist. Referring again to FIG. 4, the controller 47 is provided in the mounting cavity 43 at a position facing the air inlet 4111, the partition plate 417 is provided with a notch 4171, and the notch 4171 is provided at one side of the partition plate 417 corresponding to the controller 47. A fan 48 is provided between the air inlet 4111 and the controller 47, the fan 48 has an air indrawing opening arranged corresponding to the air inlet 4111, and an air exhaust opening arranged to face the partition plate 417, so that the fan 48 introduces air outside the housing body 411 into the housing body 411 when operating and the air flows through the controller 47 with most of the air reaching the atomizing cavity 42 through the notch 4171.

Referring to FIGS. 6 to 9, a communicating cavity (not shown) independent of the atomizing cavity 42 is also formed in the housing 41, the atomizing cavity 42 is communicated with the communicating cavity through the first communication hole 4141, and the mist outlet 4113 is communicated with the communicating cavity through the connecting pipe 46 and the second communication hole 4142, so that the air entering the atomizing cavity 42 drives the steam produced by the ultrasonic atomizing film to sequentially pass through the first communication hole 4141, the communicating cavity, the second communication hole 4142 and the communication pipe, and then discharges it from the mist outlet 4113. In other words, a complete air flow passage is formed between the air inlet 4111 and the mist outlet 4113 because the mounting cavity 43, the notch 4171, the atomizing cavity 42, the first communication hole 4141, the communicating cavity, the second communication hole 4142 and the communication pipe are provided, and the air flow passage goes through part of the controller 47. Referring back to FIGS. 4 and 5, a driving circuit board 441 for driving the ultrasonic atomizing film is further provided in the atomizing film holder 416, and the controller 47 is connected to the driving circuit board 441 and the fan 48, respectively, for controlling the start/stop of the ultrasonic atomizing film and the fan 48, respectively. Herein, a bottom surface of the mounting cavity 43 is provided with a threading hole (not shown) allowing the control wire 472 to pass through, the control wire 472 has one end connected to the driving circuit board 441, and the other end connected to the controller 47 through the threading hole.

Referring to FIGS. 8 and 9, in one possible embodiment, the first cover 412 is provided with a transverse rib 414 fixedly connected to three sequentially adjacent inner side surfaces of the first cover 412 and a vertical rib 415 fixedly connected to a top surface of the first cover 412 and two opposite ones of the three sequentially adjacent inner side surfaces, whereby the transverse rib 414, the vertical rib 415 and the three sequentially adjacent inner side surfaces jointly enclose the communicating cavity, and the second housing cover 413 can cover the communicating cavity. Referring to FIGS. 4, 7 and 8, the transverse rib 414 is provided with the first communication hole 4141 and the second communication hole 4142 corresponding to the atomizing cavity 42 and the mist outlet 4113, the atomizing cavity 42 is connected to the communicating cavity through the first communication hole 4141, and the mist outlet 4113 is connected to the second communication hole 4142 through the connecting pipe 46. A wind shield 4143 extends downwards from a bottom surface of the transverse rib 414 into the atomizing cavity 42 and is arranged corresponding to the notch 4171.

Referring to FIGS. 6 and 7, in one possible embodiment, the communicating cavity is further provided with a valve mechanism 45 configured to be capable of simultaneously sealing the first communication hole 4141 and the second communication hole 4142. Herein, the valve mechanism 45 includes a drive portion 451 and a sealing block 452, wherein the controller 47 is connected to the drive portion 451 and used for controlling the start/stop of the drive portion 451, and the drive portion 451 is connected to the sealing block 452 and can drive the sealing block 452 to slide reciprocally within the communicating cavity under the control of the controller 47. In the case of a cylinder, an electric cylinder or a linear motor, the drive portion 451 has an output shaft fixedly connected to the sealing block 452 to drive the sealing block 452 to slide in the communicating cavity. A bottom surface of the sealing block 452 is capable of covering both the first communication hole 4141 and the second communication hole 4142, and the holes may be properly sealed when covered.

Such an arrangement is advantageous in that the atomizing generator 4 of the present invention is highly integrated by dividing the housing body 411 into the atomizing cavity 42 and the mounting cavity 43 with the partition plate 417 and providing the controller 47 in the mounting cavity 43 to be connected to the driving circuit board 441, the drive portion 451 and the fan 48, respectively, so that the controller 47 can control the start/stop of the ultrasonic atomizing film, the drive portion 451 and the fan 48 simultaneously, hence this arrangement gets rid of the trouble of connecting each of these components in a step when assembling the washing machine, and enables an improved assembling efficiency. The fan 48 is disposed between the controller 47 and the air inlet 4111, the air indrawing opening of the fan 48 is arranged corresponding to the air inlet 4111, the air exhaust opening of the fan 48 is arranged to face the partition plate 417, and the partition plate 417 is provided with the notch 4171 corresponding to the position of the controller 47; when the atomizing generator 4 is working, the air flows over the controller 47 to dissipate heat from the controller 47, so that the service life and the stability of the controller 47 are improved.

The communicating cavity is arranged on the first housing cover 412 while the mist outlet 4113 is arranged on the bottom surface of the housing body 411, and the mist outlet 4113 is connected to the second communication hole 4142 through the communication pipe, hence a complete air flow passage is formed among the mounting cavity 43, the atomizing cavity 42, the communicating cavity and the communication pipe, and the mist is naturally and strongly discharged in conjunction with the action of the fan 48. The arrangement of the mist outlet 4113 on the bottom surface of the housing 41 facilitates the connection of the mist outlet 4113 with the mist outlet pipe 7, the mist outlet pipe 7 can be connected to the outer drum 3 without bending, which shortens a stroke of spraying the mist and improves the effect of spraying the mist. The arrangement where the wind shield 4143 extends from the bottom surface of the transverse rib 414 corresponding to the notch 4171 enables the wind blown by the fan 48 to bypass after passing through the notch 4171, so that the mist is better carried by the wind and gets quickly discharged, without remaining in the atomizing cavity 42 while the wind has blown over. The atomizing element 44 is hermetically arranged outside the housing body 411 by the atomizing film holder 416, and the threading hole is arranged in the mounting cavity 43, so that the control wire 472 avoids the atomizing cavity 42, which addresses the safety problem caused by contact of the control wire 472 with water and improves the safety of the atomizing generator 4.

With the ultrasonic atomizing film adopted as the atomizing element 44, the atomizing generator 4 utilizes electronic high-frequency oscillation (at a frequency of 1.7 MHz or 2.4 MHz and other frequencies beyond the auditory range, definitely harmless to human bodies and animals), as such, the molecular structure of liquid water is scattered through the high-frequency resonance of the atomizing film to generate naturally a dissipated mist, that is, the water is converted into ultramicro particles sized from 1 to 100 micrometers uniformly without heating or addition of any chemicals. Compared with atomizing by heating, the energy is saved by 90%. In addition, a large number of negative ions are released in the atomizing process, to react electrostatically with smoke, dust or the like floating in the air which is then precipitated; moreover, harmful substances such as formaldehyde, carbon monoxide, and bacteria can be effectively removed, micron-sized water molecules can be quickly adsorbed on clothes and render a better experience of clothes caring.

The arrangement of the communicating cavity in the atomizing generator 4 and of the valve mechanism 45 in the communicating cavity greatly improves the safety of operating the washing machine and effectively avoids a situation where electric elements are short-circuited due to dampness because damp-heat air flows back to the atomizing generator 4 and the inside of the washing machine when the drying module 5 is started. Specifically, the communicating cavity which is independent of the atomizing cavity 42 is provided in the housing 41, and the atomizing cavity 42 is communicated with the mist outlet 4113 through the communicating cavity, hence the communicating cavity becomes a passage necessary for the mist to reach the mist outlet 4113 from the atomizing cavity 42. The arrangement where the valve mechanism 45 is provided in the communicating cavity and can seal the first communication hole 4141 and/or the second communication hole 4142 enables that the passage can be completely cut off by the valve mechanism 45, and thus an air flow from the exterior is prevented from flowing back to the atomizing generator 4 through the mist outlet 4113, in particular, failures such as short-circuited electrical elements, affected with damp, in the atomizing generator 4 and the washing machine are avoided because the humid air in the washing drum can be prevented from flowing back to the atomizing generator 4 and then is discharged into the washing machine from the air inlet 4111 when the drying module 5 of the washing machine is started, as a result, the safety of operating the washing machine is greatly improved. Moreover, such an arrangement has high feasibility and excellent effects, advantageous for mass promotion and application.

It is to be understood that the above-described preferred embodiments are merely illustrative of the principles of the present invention and are not intended to limit the scope of the present invention. Without departing from the principles of the present invention, those skilled in the art can adjust the above-described arrangement so that the present invention can be applied to more specific applications.

For example, in an alternative embodiment, the arrangement of the valve mechanism 45 is not single and variations on this basis can be obtained by a person skilled in the art as long as the first communication hole 4141 and/or the second communication hole 4142 are sealed thereby. For example, an ordinary motor may be selected as the drive portion 451, and a transmission member may be added between the drive portion 451 and the sealing block 452 to enable the reciprocating sliding of the sealing block 452. For example, the transmission member may be a ball screw or the like. For another example, the sealing block 452 may be provided to seal only one of the first communication hole 4141 and the second communication hole 4142, and this would also be enough for the function of preventing the reflux of the damp-heat air.

For another example, in an alternative embodiment, instead of providing the fan 48 on the housing body 411, the fan 48 may be disposed within the housing body 411 or elsewhere so long as the mist can be effectively discharged from the atomizing cavity 42. For example, the fan 48 may also be provided on the mist outlet pipe 7 or the like.

For another example, in another alternative embodiment, a person skilled in the art would also be able to adjust the position of the communicating cavity, so long as the communicating cavity is such arranged that the atomizing cavity 42 is independent of the communicating cavity. For example, the communicating cavity may also be provided inside the housing body 411 instead of on the first housing cover 412.

For another example, in another alternative embodiment, the position of the mist outlet 4113 is not single, and it may also be provided on a side wall of the housing body 411, on the first housing cover 412, on the second housing cover 413 or the like, which requires only adjustment of the positions of the second communication hole 4142 and the connecting pipe 46 accordingly. This adjustment of the position of the mist outlet 4113 does not depart from the principles of the present invention.

For another example, in an alternative embodiment, in addition to the ultrasonic atomizing film, apparently conventional heating elements and the like may be used as the atomizing element 44 so long as the atomizing generator element 44 is so configured and positioned to produce a mist from the water contained in the atomizing cavity 42.

Surely, combinations of the alternative embodiments described above, as well as combinations of the alternative and preferred embodiments, may also be allowed to produce additional embodiments adapted to more specific applications.

The operation of the drum washing machine in one possible embodiment will now be described with reference to FIGS. 1 to 9.

In one possible embodiment, once the user selects the steam option on a control panel of the drum washing machine, the solenoid valve 8 is opened, water enters the atomizing cavity 42, upon the arrival of the water at a set level, the solenoid valve 8 is closed, the controller 47 controls the driving circuit board 441 and the fan 48 to be simultaneously started, the ultrasonic atomizing film atomizes the water in the atomizing cavity 42, and the fan 48 introduces ambient air into the mounting cavity 43 through the air inlet 4111, the air flows through the controller 47 to cool the controller 47, flows then into the atomizing cavity 42 through the notch 4171, and drives the steam produced by the ultrasonic atomizing film to pass through the first communication hole 4141, the communicating cavity, the second communication hole 4142, the communication pipe, the mist outlet 4113 and the mist outlet pipe 7 sequentially, and at last the steam is sprayed into the inner drum 2 to treat clothes.

Embodiment 2

Figure 10:
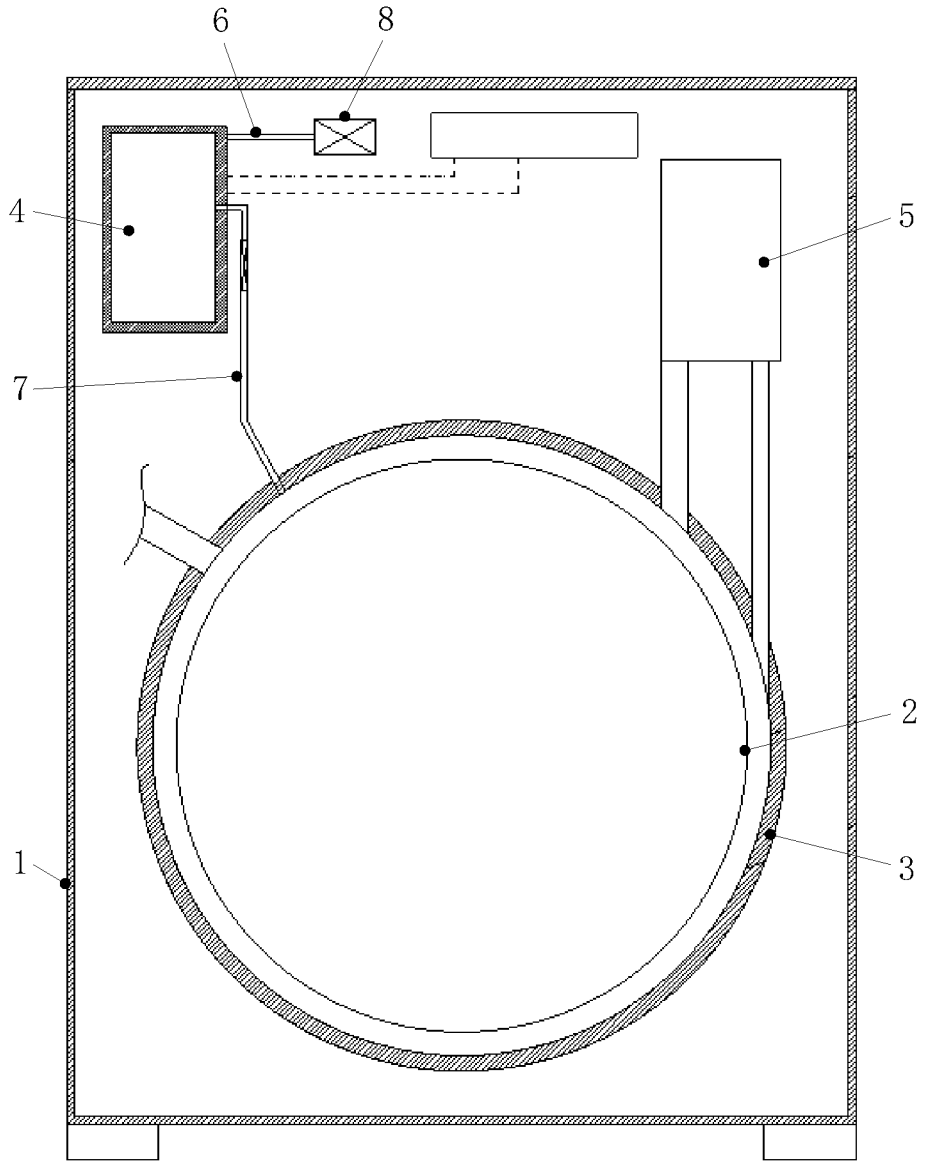
FIG. 10 is a schematic view showing a structure of a drum washing machine according to Embodiment 2 of the present invention.
Figure 11:
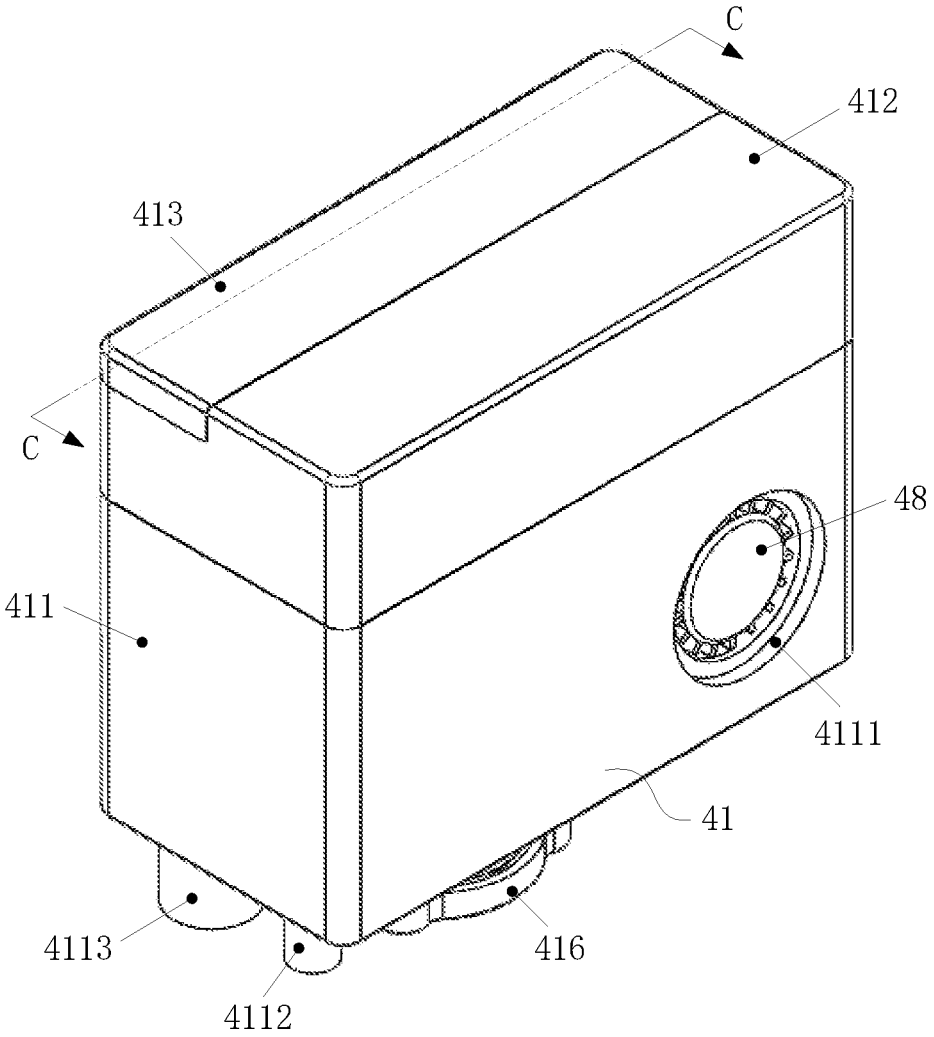
FIG. 11 is an external view (I) of an atomizing generator according to Embodiment 2 of the present invention.
Figure 12:
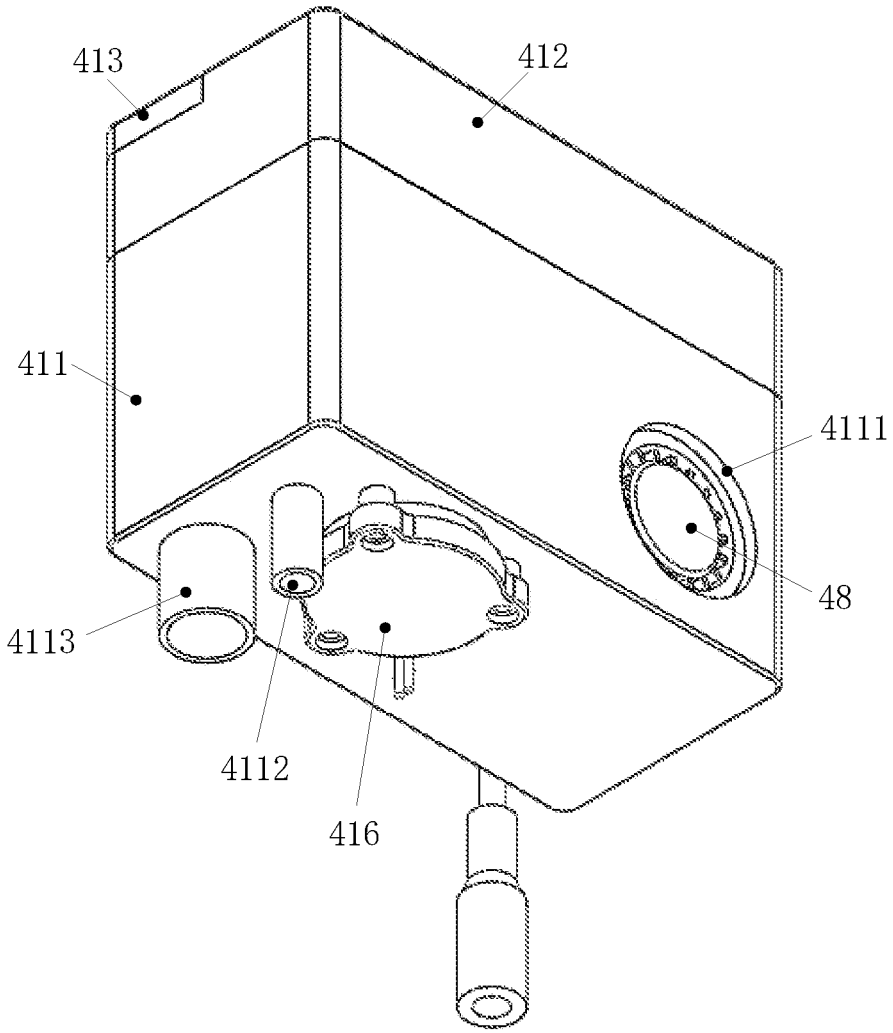
FIG. 12 is an external view (II) of the atomizing generator according to Embodiment 2 of the present invention.
Figure 13:
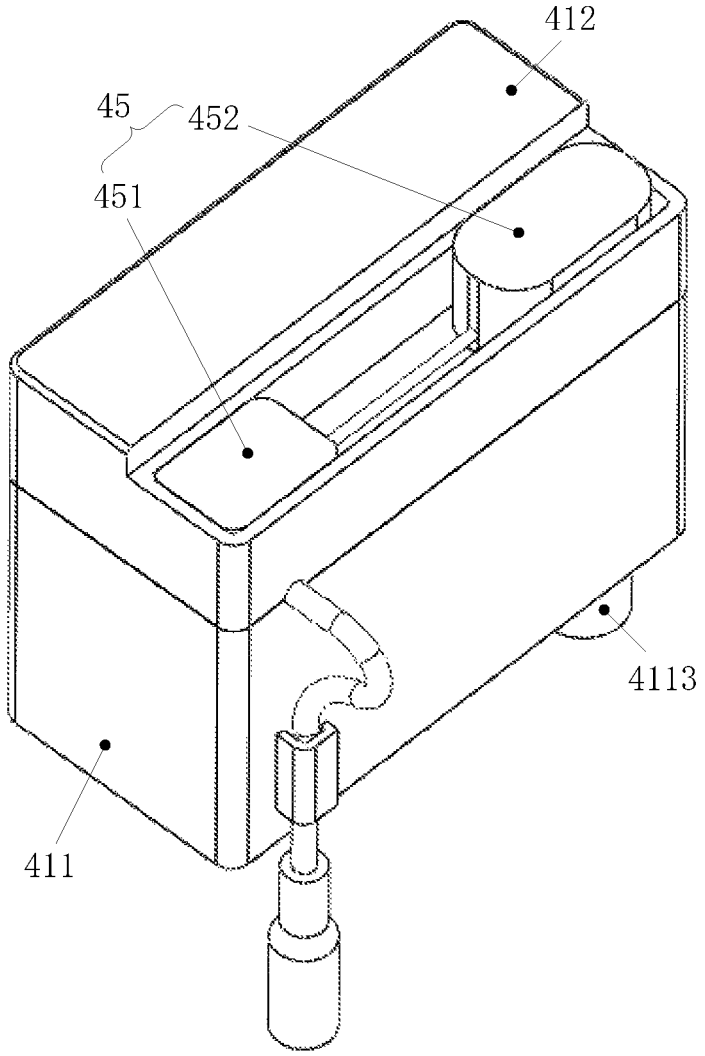
FIG. 13 is a structural view of the atomizing generator according to Embodiment 2 of the present invention with the second housing cover removed.
Figure 14:
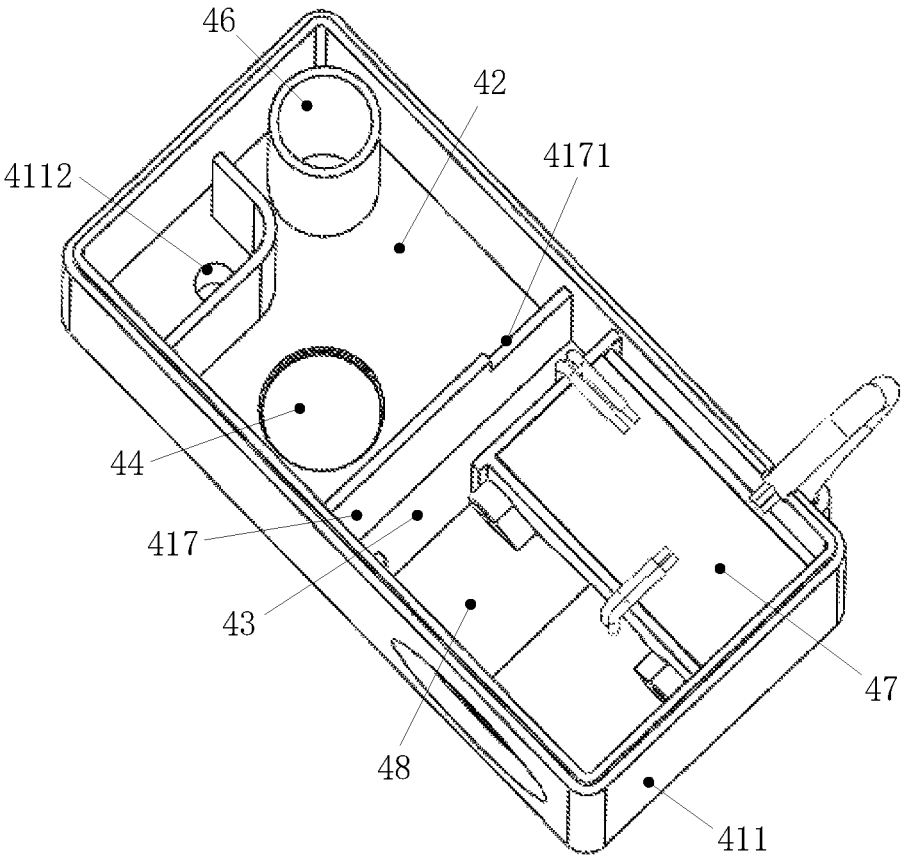
FIG. 14 is a structural view showing an interior of a housing body of the atomizing generator according to Embodiment 2 of the present invention.

The drum washing machine of the present invention will now be described with reference to FIGS. 10 to 14, wherein FIG. 10 is a schematic view showing a structure of a drum washing machine according to Embodiment 2 of the present invention; FIG. 11 is an external view (I) of an atomizing generator according to Embodiment 2 of the present invention; FIG. 12 is an external view (II) of the atomizing generator according to Embodiment 2 of the present invention; FIG. 13 is a structural view of the atomizing generator according to Embodiment 2 of the present invention with the second housing cover removed; FIG. 14 is a structural view showing an interior of a housing body of the atomizing generator according to Embodiment 2 of the present invention.

As shown in FIG. 10, to solve the problem that the safety of operating the washing machine is seriously affected by the damp-heat air in the washing drum flows back to the atomizing generator and the inside of the washing machine when the drying module of the conventional washing machine is working, the drum washing machine mainly includes a tank 1, and an inner drum 2, an outer drum 3, an atomizing generator 4 and a drying module 5 provided in the tank 1. The inner drum 2 is used for containing clothes, and the drying module 5 is circularly communicated with the outer drum 3 to dry clothes in the inner drum 2 by providing a hot air flow to the outer drum 3 and the inner drum 2. The atomizing generator 4 is communicated with the water source through the liquid inlet pipe 6 and the electromagnetic valve 8, and is communicated with the outer drum 3 through the mist outlet pipe 7; when the atomizing generator 4 is working, the water enters the atomizing generator 4 through the electromagnetic valve 8 and the liquid inlet pipe 6 from the water source, the atomizing generator 4 atomizes the water into mist, and the mist is sprayed to the inner drum 2 through the mist outlet pipe 7 to treat clothes in the inner drum 2.

Referring to FIGS. 11 and 14, the atomizing generator 4 includes the housing 41 provided therein with the atomizing cavity 42 capable of storing water, the atomizing element 44 capable of atomizing water is provided in the atomizing cavity 42, and the air inlet 4111, the liquid inlet 4112 and the mist outlet 4113 which are communicated with the atomizing cavity 42 are provided on the housing 41, the liquid inlet 4112 being connected to the liquid inlet pipe 6, and the mist outlet 4113 being connected to the mist outlet pipe 7. Specifically, referring to FIG. 13, the communicating cavity (not shown) independent of the atomizing cavity 42 is further formed in the housing 41, the atomizing cavity 42 is communicated with the communicating cavity through the first communication hole 4141 (shown in FIG. 16), and the mist outlet 4113 is communicated with the communicating cavity through the second communication hole 4142. The valve mechanism 45 is further provided in the communicating cavity and is configured to be capable of sealing the first communication hole 4141 and the second communication hole 4142 simultaneously.

When the drying module 5 is working, the drying module 5 releases a large amount of hot air flow into the outer drum 3 and the inner drum 2 to dry clothes. In the drying process, the pressure in the drum is increased, and the humidity of the air is obviously increased as clothes is dried, as a result, the damp-heat air easily flows back to the atomizing generator 4 through the mist outlet pipe 7 and is then expelled to the interior of the washing machine from the air inlet 4111, consequently, the electrical elements in the atomizing generator 4 and inside the washing machine are short-circuited due to damp, which leads to safety issues. At this time, the first communication hole 4141 and the second communication hole 4142 are sealed by the control valve mechanism 45 so that the passage between the mist outlet 4113 and the atomizing cavity 42 is blocked.

As can be seen from the above description, in the present invention, the arrangement of the communicating cavity in the atomizing generator 4 and of the valve mechanism 45 in the communicating cavity greatly improves the safety of operating the washing machine and effectively avoids a situation where electric elements are short-circuited due to dampness because damp-heat air flows back to the atomizing generator 4 and the inside of the washing machine when the drying module 5 is started. Specifically, the communicating cavity which is independent of the atomizing cavity 42 is provided in the housing 41, and the atomizing cavity 42 is communicated with the mist outlet 4113 through the communicating cavity, hence the communicating cavity becomes a passage necessary for the mist to reach the mist outlet 4113 from the atomizing cavity 42. The arrangement where the valve mechanism 45 is provided in the communicating cavity and can seal the first communication hole 4141 and/or the second communication hole 4142 enables that the passage can be completely cut off by the valve mechanism 45, and thus an air flow from the exterior is prevented from flowing back to the atomizing generator 4 through the mist outlet 4113, in particular, failures such as short-circuited electrical elements, affected with damp, in the atomizing generator 4 and the washing machine are avoided because the humid air in the washing drum can be prevented from flowing back to the atomizing generator 4 and then is discharged into the washing machine from the air inlet 4111 when the drying module 5 of the washing machine is started, as a result, the safety of operating the washing machine is greatly improved. Moreover, such an arrangement has high feasibility and excellent effects, advantageous for mass promotion and application.

Figure 15:
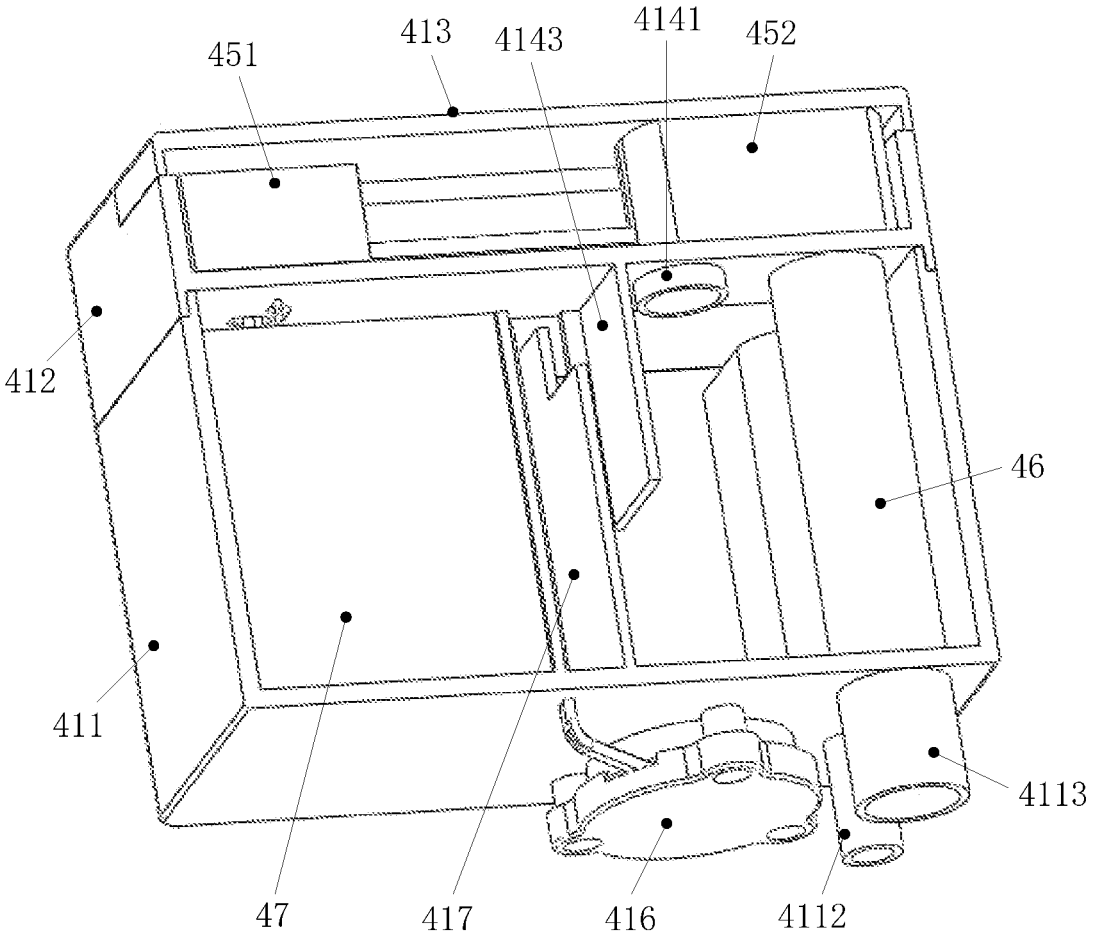
FIG. 15 is a cross-sectional view of FIG. 11 at C-C.
Figure 16:
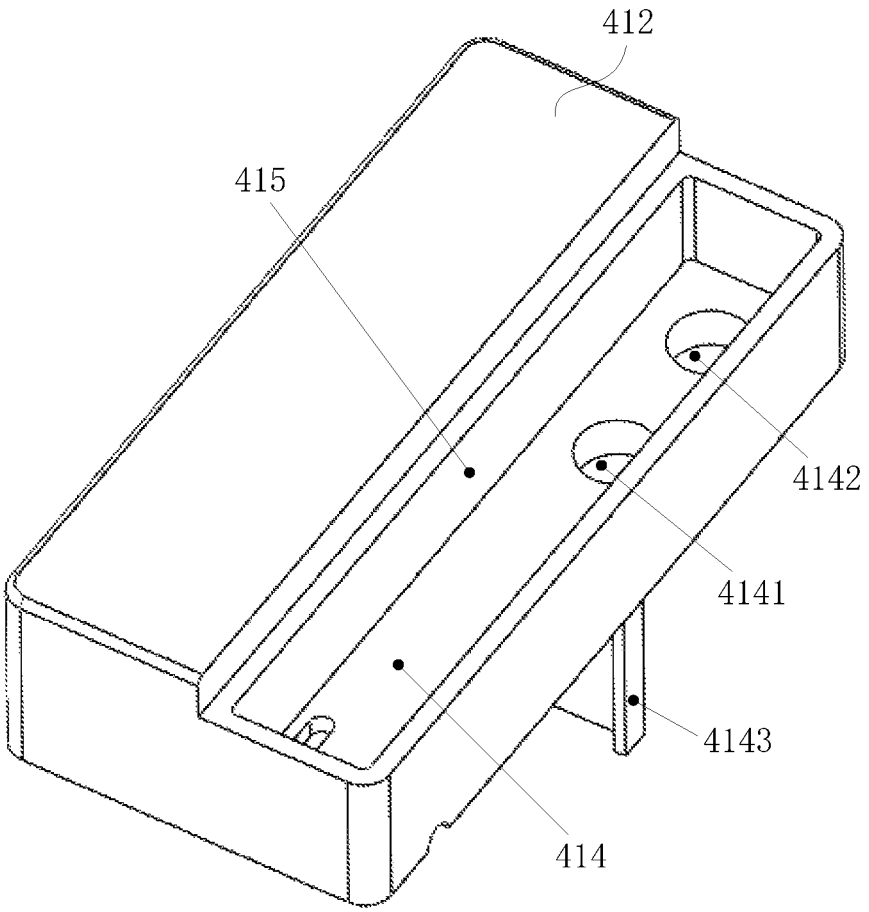
FIG. 16 is a structural view (I) of a first housing cover of the atomizing generator according to Embodiment 2 of the present invention.
Figure 17:
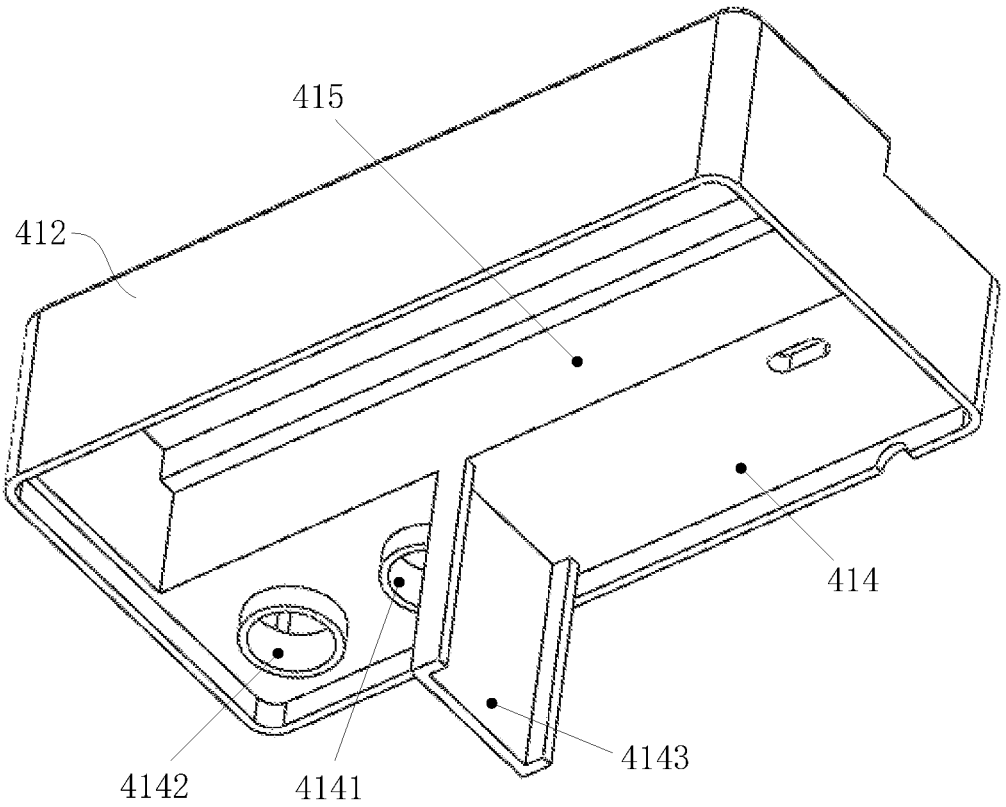
FIG. 17 is a structural view (II) of the first housing cover of the atomizing generator according to Embodiment 2 of the present invention.

The atomizing generator will be described in detail with reference to FIGS. 11 to 17, wherein FIG. 15 is a cross-sectional view of FIG. 11 at C-C; FIG. 16 is a structural view (I) of a first housing cover of the atomizing generator according to Embodiment 2 of the present invention; FIG. 17 is a structural view (II) of the first housing cover of the atomizing generator according to Embodiment 2 of the present invention.

As shown in FIGS. 11, 12 and 14, in one possible embodiment, the housing 41 includes the housing body 411, the first housing cover 412, and the second housing cover 413, the partition plate 417 is disposed in the housing body 411 to divide the housing body 411 into the atomizing cavity 42 and the mounting cavity 43, the liquid inlet 4112 and the mist outlet 4113 are arranged on the bottom surface of the housing body 411 at a side corresponding to the atomizing cavity 42, the air inlet 4111 is disposed at the position of the side surface of the housing body 411 corresponding to the mounting cavity 43, the fan 48 is disposed in the air inlet 4111, the partition plate 417 is provided with the notch 4171, and the fan 48 introduces air outside the housing body 411 into the housing body 411, with most of the air reaching the atomizing cavity 42 through the notch 4171. The water-permeable hole (not shown) is also provided at the bottom of the housing body 411, and the atomizing element 44 is preferably an ultrasonic atomizing film provided outside the housing body 411 and hermetically connected at the water-permeable hole by the atomizing film holder 416 for atomizing the liquid in the atomizing cavity 42 into a mist.

Referring to FIGS. 16 and 17, the first housing cover 412 is provided with the transverse rib 414 and the vertical rib 415, the transverse rib 414 is fixedly connected to three sequentially adjacent inner side surfaces of the first housing cover 412, and the vertical rib 415 is fixedly connected to the top surface of the first housing cover 412 and two opposite ones of the three sequentially adjacent inner side surfaces, so that the transverse rib 414, the vertical rib 415 and three sequentially adjacent inner side surfaces jointly enclose the communicating cavity, and the second housing cover 413 can cover the communicating cavity. Referring to FIGS. 12, 15 and 16, the transverse rib 414 is provided with the first communication hole 4141 and the second communication hole 4142 corresponding to the atomizing cavity 42 and the mist outlet 4113, the atomizing cavity 42 is connected to the communicating cavity through the first communication hole 4141, and the mist outlet 4113 is connected to the second communication hole 4142 through the connecting pipe 46. The wind shield 4143 extends downwards from the bottom surface of the transverse rib 414 into the atomizing cavity 42 and is arranged corresponding to the notch 4171.

Referring to FIGS. 13 and 15, in one possible embodiment, the valve mechanism 45 includes the drive portion 451 and the sealing block 452, the drive portion 451 is connected to the sealing block 452 and is capable of driving the sealing block 452 to slide reciprocally within the communicating cavity. In the case of a cylinder, an electric cylinder or a linear motor, the drive portion 451 has an output shaft fixedly connected to the sealing block 452 to drive the sealing block 452 to slide in the communicating cavity. The bottom surface of the sealing block 452 is capable of covering both the first communication hole 4141 and the second communication hole 4142, and the holes may be properly sealed when covered.

Referring back to FIG. 14, the controller 47 is further provided in the mounting cavity 43 at a position facing the air inlet 4111, the controller 47 is connected to the ultrasonic atomizing film, the drive portion 451 and the fan 48, respectively, for controlling the start/stop of the ultrasonic atomizing film, the drive portion 451 and the fan 48, respectively.

The above arrangement is advantageous in that the communicating cavity is arranged on the first housing cover while the mist outlet 4113 is arranged on the bottom surface of the housing body 411, and the mist outlet 4113 is connected to the second communication hole 4142 through the communication pipe, hence a complete air flow passage is formed among the atomizing cavity 42, the communicating cavity and the communication pipe, and the mist is naturally and strongly discharged in conjunction with the action of the fan 48. The arrangement of the mist outlet 4113 on the bottom surface of the housing 41 facilitates the connection with the mist outlet pipe 7, the mist outlet pipe 7 can be connected to the outer drum 3 without bending, which shortens a stroke of spraying the mist and improves the effect of spraying the mist. The arrangement of the sealing block 452 to cover and seal both the first communication hole 4141 and the second communication hole 4142 renders better effects in blocking and sealing the damp-heat air with the valve mechanism 45. Additionally, the air inlet 4111 is arranged corresponding to the mounting cavity 43, the controller 47 is arranged at the position facing the air inlet 4111, so that the fan 48 can be used for dissipating heat from the controller 47 when the atomizing generator 4 works, which improves the service life and the stability of the controller 47. The arrangement of the wind shield 4143 extending from the bottom surface of the transverse rib 414 corresponding to the notch 4171 enables the wind blown by the fan 48 to bypass after passing through the notch 4171, so that the mist is better carried by the wind and gets quickly discharged, without remaining in the atomizing cavity 42 while the wind has blown over.

With the ultrasonic atomizing film adopted as the atomizing element 44, the atomizing generator 4 utilizes electronic high-frequency oscillation (at a frequency of 1.7 MHz or 2.4 MHz and other frequencies beyond the auditory range, definitely harmless to human bodies and animals), as such, the molecular structure of liquid water is scattered through the high-frequency resonance of the atomizing film to generate naturally a dissipated mist, that is, the water is converted into ultramicro particles sized from 1 to 100 micrometers uniformly without heating or addition of any chemicals. Compared with atomizing by heating, the energy is saved by 90%. In addition, a large number of negative ions are released in the atomizing process, to react electrostatically with smoke, dust and the like floating in the air which are then precipitated; moreover, harmful substances such as formaldehyde, carbon monoxide, and bacteria can be effectively removed, micron-sized water molecules can be quickly adsorbed on clothes and render a better experience of clothes caring.

It is to be understood that the above-described preferred embodiments are merely illustrative of the principles of the present invention and are not intended to limit the scope of the present invention. Without departing from the principles of the present invention, those skilled in the art can adjust the above-described arrangement so that the present invention can be applied to more specific applications.

For example, in an alternative embodiment, the arrangement of the valve mechanism 45 is not single and variations on this basis can be obtained by a person skilled in the art as long as the first communication hole 4141 and/or the second communication hole 4142 are sealed thereby. For example, an ordinary motor may be selected as the drive portion 451, and a transmission member may be added between the drive portion 451 and the sealing block 452 to enable the reciprocating sliding of the sealing block 452. For example, the transmission member may be a ball screw or the like. For another example, the sealing block 452 may be provided to seal only one of the first communication hole 4141 and the second communication hole 4142, and this would also be enough for the function of preventing the reflux of the damp-heat air.

For another example, in another alternative embodiment, instead of providing the controller 47 in the housing body 411, a control unit of the drum washing machine may be used to control the start/stop of the drive portion 451, the fan 48 and the ultrasonic atomizing film, without departing from the principles of the present invention.

For another example, in an alternative embodiment, instead of providing the fan 48 on the housing body 411, the fan 48 may be disposed within the housing body 411 or elsewhere so long as the mist can be effectively discharged from the atomizing cavity 42. For example, the fan 48 may also be provided on the mist outlet pipe 7 or the like.

For another example, in another alternative embodiment, a person skilled in the art would also be able to adjust the position of the communicating cavity, so long as the communicating cavity is such arranged that the atomizing cavity 42 is independent of the communicating cavity. For example, the communicating cavity may also be provided inside the housing body 411 instead of on the first housing cover 412.

For another example, in another alternative embodiment, the position of the mist outlet 4113 is not single, and it may also be provided on a side wall of the housing body 411, on the first housing cover 412, on the second housing cover 413 or the like, which requires only adjustment of the positions of the second communication hole 4142 and the connecting pipe 46 accordingly. This adjustment of the position of the mist outlet 4113 does not depart from the principles of the present invention.

For another example, in an alternative embodiment, in addition to the ultrasonic atomizing film, apparently conventional heating elements and the like may be used as the atomizing element 44 so long as the atomizing generator element 44 is so configured and positioned to produce a mist from the water contained in the atomizing cavity 42.

Surely, combinations of the alternative embodiments described above, as well as combinations of the alternative and preferred embodiments, may also be allowed to produce additional embodiments adapted to more specific applications.

The operation of the drum washing machine in one possible embodiment will now be described with reference to FIGS. 10 to 17.

In one possible embodiment, after the user selects the drying option on the control panel of the drum washing machine, the drying module 5 is started, and heated air is continuously fed into the outer drum 3 and the inner drum 2 for circulation. At the same time, after receiving the instruction to start the drying function, the controller 47 controls the drive portion 451 to start, and the drive portion 451 drives the sealing block 452 to slide, sealing both the first communication hole 4141 and the second communication hole 4142, which prevents damp-heat air in the drum from flowing back to the atomizing generator 4 through the mist outlet pipe 7. After the drying process is finished, for example, after receiving an instruction that the door of the drum washing machine is opened, the controller 47 controls the drive portion 451 to start again, and the drive portion 451 drives the sealing block 452 to slide reversely, leaving the first communication hole 4141 and the second communication hole 4142, so that the first communication hole 4141 and the second communication hole 4142 are communicated.

Thus far, the technical solutions of the present invention have been described with reference to preferred embodiments shown in the accompanying drawings, but it will be readily understood by those skilled in the art that the scope of the present invention is obviously not limited to these specific embodiments. Those skilled in the art can make equivalent alterations or substitutions to the relevant features without departing from the principles of the present invention, and such alterations or substitutions are intended to fall within the scope of the present invention.

What is claimed is:

1. An atomizing generator, comprising:

a housing provided with a partition plate therein, the partition plate dividing the housing into an atomizing cavity and a mounting cavity which are communicated with each other, and the atomizing cavity being capable of containing a liquid, wherein the housing is provided with an air inlet, a liquid inlet and a mist outlet which are communicated with the atomizing cavity, an atomizing element capable of atomizing the liquid in the atomizing cavity, and a controller being provided in the mounting cavity, wherein the controller is connected to the atomizing element through a control wire to control the start/stop of the atomizing element, wherein a communicating cavity is further provided in the housing, the atomizing cavity is communicated with the communicating cavity through a first communication hole, and the mist outlet is communicated with the communicating cavity through a second communication hole, and wherein:

the mist outlet is disposed on a bottom surface of the housing, the atomizing generator further comprises a connecting pipe, and the mist outlet is communicated with the second communication hole through the connecting pipe; and/or a valve mechanism is further provided in the communicating cavity, wherein the valve mechanism is configured to be capable of sealing the first communication hole and/or the second communication hole, and wherein the controller is connected to the valve mechanism to control the opening/closing of the valve mechanism.

2. The atomizing generator according to claim 1, wherein:

the atomizing element is an ultrasonic atomizing film, a bottom of the housing is provided with a water-permeable hole, and the ultrasonic atomizing film is fixed by an atomizing film holder outside the housing corresponding to the water-permeable hole.

3. The atomizing generator according to claim 2, wherein:

a driving circuit board used for driving the ultrasonic atomizing film is further mounted in the atomizing film holder, a threading hole is formed in a bottom surface of the mounting cavity, and the control wire has one end connected to the driving circuit board and the other end connected to the controller through the threading hole.

4. The atomizing generator according to claim 1, wherein:

the air inlet is disposed at a position on the housing corresponding to the mounting cavity, an air flow passage is formed between the air inlet and the mist outlet, and the air flow passage goes through part of the controller.

5. The atomizing generator according to claim 4, wherein:

the housing comprises a housing body and a housing cover, the partition plate is disposed in the housing body and is provided with a notch, and the notch is arranged corresponding to the controller.

6. The atomizing generator according to claim 5, wherein:

a wind shield extends downwards from the housing cover, and the wind shield extends into the atomizing cavity and is arranged corresponding to the notch.

7. The atomizing generator according to claim 1, wherein:

a fan is provided between the air inlet and the controller, an air indrawing opening of the fan is arranged corresponding to the air inlet, an air exhaust opening of the fan is arranged to face the partition plate, and the controller is connected to the fan to control the start/stop of the fan.

8. A clothes treatment apparatus, comprising:

a tank, a washing drum and a control unit which are provided in the tank, and an atomizing generator comprising a housing provided with a partition plate therein, the partition plate dividing the housing into an atomizing cavity and a mounting cavity which are communicated with each other, and the atomizing cavity being capable of containing a liquid, wherein the housing is provided with an air inlet, a liquid inlet and a mist outlet which are communicated with the atomizing cavity, wherein the atomizing generator further comprises:

an atomizing element capable of atomizing the liquid in the atomizing cavity, a controller is provided in the mounting cavity, and the controller is connected to the atomizing element through a control wire to control the start/stop of the atomizing element, the liquid inlet being communicated with a water source through a liquid inlet pipe, the mist outlet being communicated with the washing drum through a mist outlet pipe, and the controller being connected to the control unit through a cable, wherein a communicating cavity is further provided in the housing, the atomizing cavity is communicated with the communicating cavity through a first communication hole, and the mist outlet is communicated with the communicating cavity through a second communication hole, and wherein:

the mist outlet is disposed on a bottom surface of the housing, the atomizing generator further comprises a connecting pipe, and the mist outlet is communicated with the second communication hole through the connecting pipe; and/or a valve mechanism is further provided in the communicating cavity, wherein the valve mechanism is configured to be capable of sealing the first communication hole and/or the second communication hole, and wherein the controller is connected to the valve mechanism to control the opening/closing of the valve mechanism.

* * * * *